US010431093B2

(12) United States Patent
Wiklinska et al.

(10) Patent No.: US 10,431,093 B2
(45) Date of Patent: Oct. 1, 2019

(54) SYSTEM AND METHOD FOR COLLISION AVOIDANCE

(71) Applicant: ZF Friedrichshafen AG, Friedrichshafen (DE)

(72) Inventors: Malgorzata Wiklinska, Royal Oak, MI (US); Gerhard Deuter, Tettnang (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 15/628,136

(22) Filed: Jun. 20, 2017

(65) Prior Publication Data

US 2018/0365999 A1 Dec. 20, 2018

(51) Int. Cl.
*G08G 1/16* (2006.01)

(52) U.S. Cl.
CPC ..... *G08G 1/166* (2013.01); *G08G 1/164* (2013.01)

(58) Field of Classification Search
CPC ..... G08G 1/166
See application file for complete search history.

(56) References Cited

U.S. PATENT DOCUMENTS

| | | | | |
|---|---|---|---|---|
| 9,836,980 | B2 | 12/2017 | Sommer et al. | |
| 10,127,815 | B2 | 11/2018 | Hernandez et al. | |
| 2015/0248836 | A1* | 9/2015 | Alselimi | G06K 9/00785 348/149 |
| 2016/0180713 | A1* | 6/2016 | Bernhardt | B66F 17/003 701/70 |
| 2016/0368492 | A1* | 12/2016 | Al-Stouhi | B60W 30/18154 |
| 2017/0191834 | A1* | 7/2017 | Fowe | G01C 21/10 |

FOREIGN PATENT DOCUMENTS

DE 10 2014 219 148 A1 3/2016

* cited by examiner

*Primary Examiner* — Brian A Zimmerman
*Assistant Examiner* — Sara B Samson
(74) *Attorney, Agent, or Firm* — Brinks Gilson & Lione

(57) ABSTRACT

One general aspect of the present disclosure includes a method for warning of collision avoidance. The method may include receiving, with at least one server, position and movement information from a remote client, forming a motion model of the client including a predicted position of the client at a future time, and determining whether an object will be in a proximity of the position of the client at the time. If the object will be in the proximity of the position of the client at the time, the method may include determining a probability of a collision between the client and the object at the time. If the probability meets a threshold, the method may include transmitting a collision avoidance signal to at least one of the client and the object.

8 Claims, 8 Drawing Sheets

SYSTEM AND METHOD FOR COLLISION AVOIDANCE

TECHNICAL FIELD

This disclosure relates to a system and method for collision avoidance between two or more objects, such as two or more road users.

BACKGROUND

Intersections, and particularly those with road crossings, are critical areas of vulnerability for road users. Road users may include vehicles (cars, trucks, motorcycles, etc.), walking pedestrians, cyclists, and other mobile objects. Many of the most common accident scenarios resulting in serious injuries and fatalities include collisions between passenger vehicles and a pedestrian walking through a road crossing (legally or illegally) and cyclists performing maneuvers on roadways that are unpredictable to the driver of the passenger vehicle. Current collision avoidance systems used by passenger vehicles, which have been developed in the attempt to alleviate some of these dangers, relay on classic line-of-sight sensors, such as cameras, radar, and LIDAR. However, these classic sensors may not provide adequate warning to the driver of the passenger vehicle when the collision occurs as the vehicle rounds a turn or when the pedestrian or cyclist makes a sudden movement that is unpredictable to the driver. It would thus be advantageous to provide a system capable of warning of a potential collision without relying on line-of-sight sensors.

BRIEF SUMMARY

One general aspect of the present disclosure includes a method for warning of collision avoidance. The method may include receiving, with at least one server, position and movement information from a remote client, forming a motion model of the client including a predicted position of the client at a future time, and determining whether an object will be in a proximity of the position of the client at the time. If the object will be in the proximity of the position of the client at the time, the method may include determining a probability of a collision between the client and the object at the time. If the probability meets a threshold, the method may include transmitting a collision avoidance signal to at least one of the client and the object.

Another general aspect of the present disclosure includes a method including the steps of receiving, with at least one server, position and movement information from a remote first client and forming a motion model including a predicted position of the first client at a future time, and receiving, with the at least one server, position and movement information from a remote second client and forming a second motion model of the second client including a predicted position of the second client at the future time. The method may further include determining whether the second client will be in a proximity of the position of the first client at the time.

Another general aspect of the present disclosure includes a collision avoidance system. The collision avoidance system may include a sensor coupled to a client and configured to measure position and movement information of the client, and at least one server configured to receive the position and movement information from the client and to form a motion model of the client. The motion model may include a predicted position of the client at a future time, where the at least one server is configured to determine whether an object will be in a proximity of the position of the client at the time, to determining a probability of a collision between the client and the object at the time if the object will be in the proximity of the position of the client at the time, and to transmit a collision avoidance signal to the client if the probability meets a threshold.

DETAILED DESCRIPTION

Figure 1:
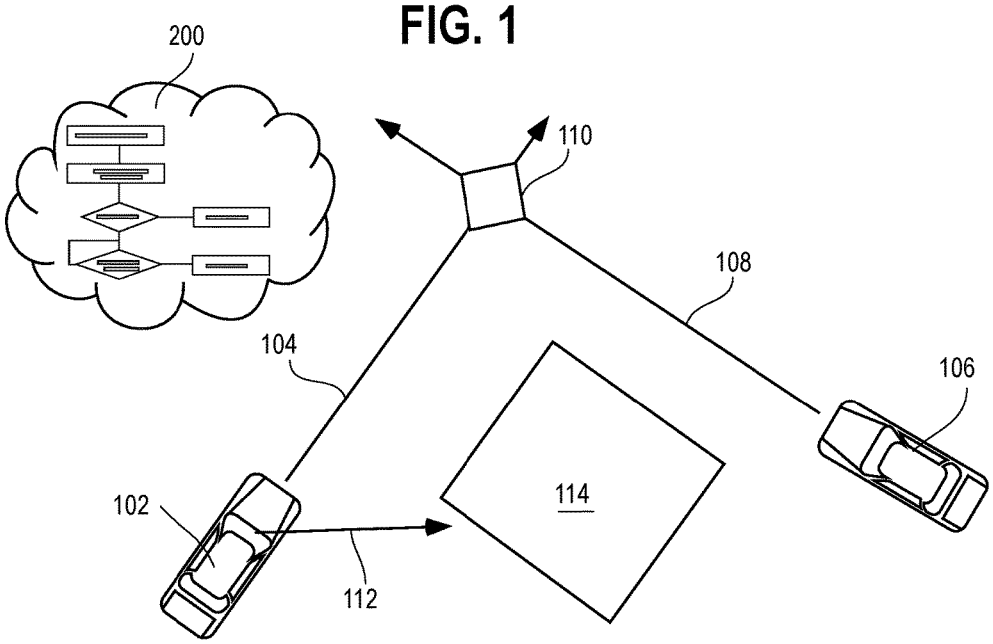
FIG. 1 is a diagram of an example of a trajectory of a first object and a trajectory of a second object, where the second object is not within the line of sight of the first object, and a system for collision avoidance.

Referring to FIG. 1, the present embodiments are related to a system 200 for providing safety for road users with a collision avoidance system. For example, the present embodiments may provide the system 200 for preventing, reducing the probability, and/or warning of potential collisions between a client and another object (where the "client" is also an object), such as between a vehicle and another object. The objects may be vehicles, cyclists, skateboarders, walking pedestrians, animals (e.g., pets), small electric vehicles (e.g., mopeds, electric wheelchairs, etc.), and the like. As described in more detail below, the system may provide real-time collision anticipation without direct line-of-sight detection through the use wireless transmission technologies. Herein, "line-of-sight" may include sightlines (e.g., of a human eye or a camera) as well as direct, straight-line paths of radar waves, LIDAR waves, or other pulses of light or other wavelengths.

FIG. 1 is a diagram of an example client 102 with a first trajectory 104 and an object 106 with a second trajectory. Herein, a "trajectory" is not necessarily limited to a single vector of information, but may include any projected movements, including curves and turns, of the client (i.e., at least two spatial dimensions and a time dimension). In this case, the client 102 is depicted as a first vehicle and the object 106 is depicted as a second vehicle, but any other mobile object is contemplated for either or both of the client and the object, and it is noted that the object 106 could be a second client utilizing the system 200 for its own collision avoidance. The first trajectory 104 and the second trajectory 108 may extend towards an intersection point 110. When the client 102 and the object 106 are traveling at certain relative speeds, the client 102 and the object 106 may arrive at the intersection point 110 at approximately the same time. Thus, unless at least one of the client 102 and the object 106 changes its speed or direction prior to reaching the intersection point 110, a collision may occur. While intersections typically are regulated by local laws and/or customs to prevent such collisions, it is not uncommon for collisions to occur when at least one object acts unpredictably (e.g., due to a mistake, ignorance of local laws or customs, ignorance or intentional disobedience with respect to local laws or customs, etc.). In some instances, a driver or operator of the client 102 may be able to alter his or her trajectory to avoid the collision if he or she is aware of the behavior of the object 106 (e.g., if the object 106 is visible from the perspective of the client 102). Further, a sensor relying on line-of-sight (e.g., a camera, an ultrasonic or radar sensor, etc.) may be provided with the client 102 to warn the respective driver that the object 106 is within close proximity. However, in some circumstances, the object 106 may be out of the line-of-sight 112 of the client 102, for example due to a blockage by an obstacle 114 (e.g., a building), if the first trajectory 104 and/or the second trajectory 108 includes turns or curves, if the weather is such that it interrupts visibility, etc. Thus, it may be advantageous for at least one of the objects to incorporate a system for warning of and/or preventing a potential collision without relying solely on methods and devices utilizing line-of-sight.

Figure 2:
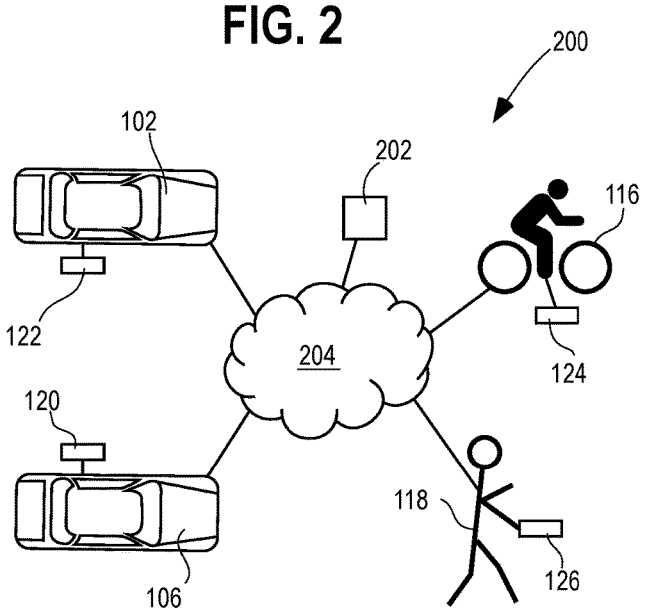
FIG. 2 is a diagram of a cloud-based system for preventing collisions between a vehicle and an object in accordance with one embodiment of the present disclosure.

FIG. 2 is a diagram showing a system 200 for preventing collisions between the client 102 and another object 106, such as a second vehicle, and/or a walking pedestrian 116, a cyclist 118, and/or any other suitable object (and it should be apparent that more than four objects may be incorporated). While this disclosure generally describes the system 200 as facilitating an interaction between the client 102 and only one object, the system 200 is preferably capable of handling multiple objects at a time. Further, each object may utilize the system 200 simultaneously for its own collision avoidance. To illustrate, the system 200 may analyze and warn the client 102 of potential collisions with the object 106 (and other objects), and at the same time, the system 200 may analyze and warn the object 106 of potential collisions with the object 116 (and other objects). Stated different, an "object" that is evaluated by the system 200 for a potential collision with the client 102 may utilize the system 200 for its own collision analysis with other objects. While in exemplary embodiments, the system 200 will have adequate computing power to handle the number of objects simultaneously using it, if the system 200 approaches its computing limit, it is contemplated that the system 200 can send a group warning to the objects and/or group objects together in a block for simplified evaluation. For example, in certain embodiments, the objects are grouped together such that they are considered one entity for purposes of simplified evaluation.

A client of the system, such as client 102, may communicate with a server 202 through a web-based and/or cloud-computing network (herein referred to as "the cloud 204"). The client may be remote with respect to the server. In particular, in some embodiments, at least a portion of the system 200 may be implemented within an AMAZON WEB SERVICES™ (AWS) cloud-computing environment. When multiple servers are used, the multiple servers may be located in the same location or may be remote with respect to one another at various locations within the cloud 204. For example, because timeliness is critical, a particular local server may be used to communicate with the client 102 when the client 102 is within the proximity of that local server, and that local server may be synced with a central server in the cloud 204. Multiple local servers may be capable of performing most or all of the processes of the system 200 but may frequently synchronize with the central server such that the data and information collected from all locations is available to each local server. The servers of the system may provide computing power to facilitate performance of any necessary computations, manage access of the databases and handle incoming service requests from the clients (which can be smart phones, wearables, vehicles, etc.), among other tasks. Any suitable network type may connect the servers of the system 200 and/or the clients of the system 200 (e.g., a client-server distributed application structure, a peer-to-peer structure, etc.), and the use of the term "client" does not limit the present embodiments to a client-server distributed application structure.

In exemplary embodiments, the client 102, the objects 106, 116, 118, and the server 202 may communicate substantially in real time. The real time communication may be provided between the client 102, the server 202, and/or the objects 106, 116, 118 with any suitable communication network. For example, the system 200 may utilize certain cellular networks or standards (e.g., 2G, 3G, 4 G Universal Mobile Telecommunications System (UMTS), 5G, GSM® Association, Long Term Evolution (LTE)™, etc.), WiMAX, Bluetooth, Wireless Fidelity (WiFi, including 802.11a/b/g/n/ac or others), WiGig, Global Positioning System (GPS) networks, and/or other suitable networks available at the time of the filing of this application or that may be developed in the future.

The system 200 may detect potential collisions based on information (e.g., location, object type, and trajectory information) received from one or more of the client 102 and the objects 106, 116, 118. For example, the client 102 may include a sensor 120, which may provide information about the position of the client 102 and/or its movement. Similarly, the objects 106, 116, 118 may include respective sensors 122, 124, 126, although some embodiments do not require each object considered by the system 200 to have a sensor. The sensors may be devices that can detect the position of their respective objects. The sensors may be a three-dimensional accelerometers, three-dimensional gyroscopes, GPS/GNSS receivers and transmitters, compass sensors, automotive v2x or x2x sensors, etc. In some embodiments, the sensor 120 may be a camera, and location data may be extracted from camera feeds using frame-by-frame road user tracking using software. The sensor 120 may be standard on the client 102. When objects include a pedestrian 116, a cyclist 118 or another non-vehicle object, the sensors 124, 126 may be provided within a smart phone, a wearable device, or any other suitable device capable of detecting location and/or movement information.

When a client or other object has a sensor, each object/client may include a controller that controls operation of the sensors and/or collects information from the sensors. For example, the controller may include a central processing unit (CPU), a memory (e.g., random access memory (RAM)), a storage device (hard disk or solid state drive), and a communication interface. The memory and storage device may store a computer program and data used for execution of the computer program, which the CPU may use to control and/or collect information from the sensors and communicate that information to other portions of the system 200. As shown, the client 102 and the objects 106, 116, 118 may communicate through one or more servers (e.g., through the cloud 204). Each of the servers of the system 200 may also include a CPU, a memory, a storage device, a communication interface, and a stored computer program or software for executing the processes of the system 200. It also contemplated that the client 102 and the objects 106, 116, 118 may communicate directly with one another (at least temporarily) such that the client 102 is aware of the information provided by the sensors 122, 124, 126 of the objects 106, 116, 118 (and/or vice versa) without necessitating a centralized server, particularly when sensor communication is interrupted (e.g., when the client 102 and/or an object is in a tunnel, for example).

Figure 3:
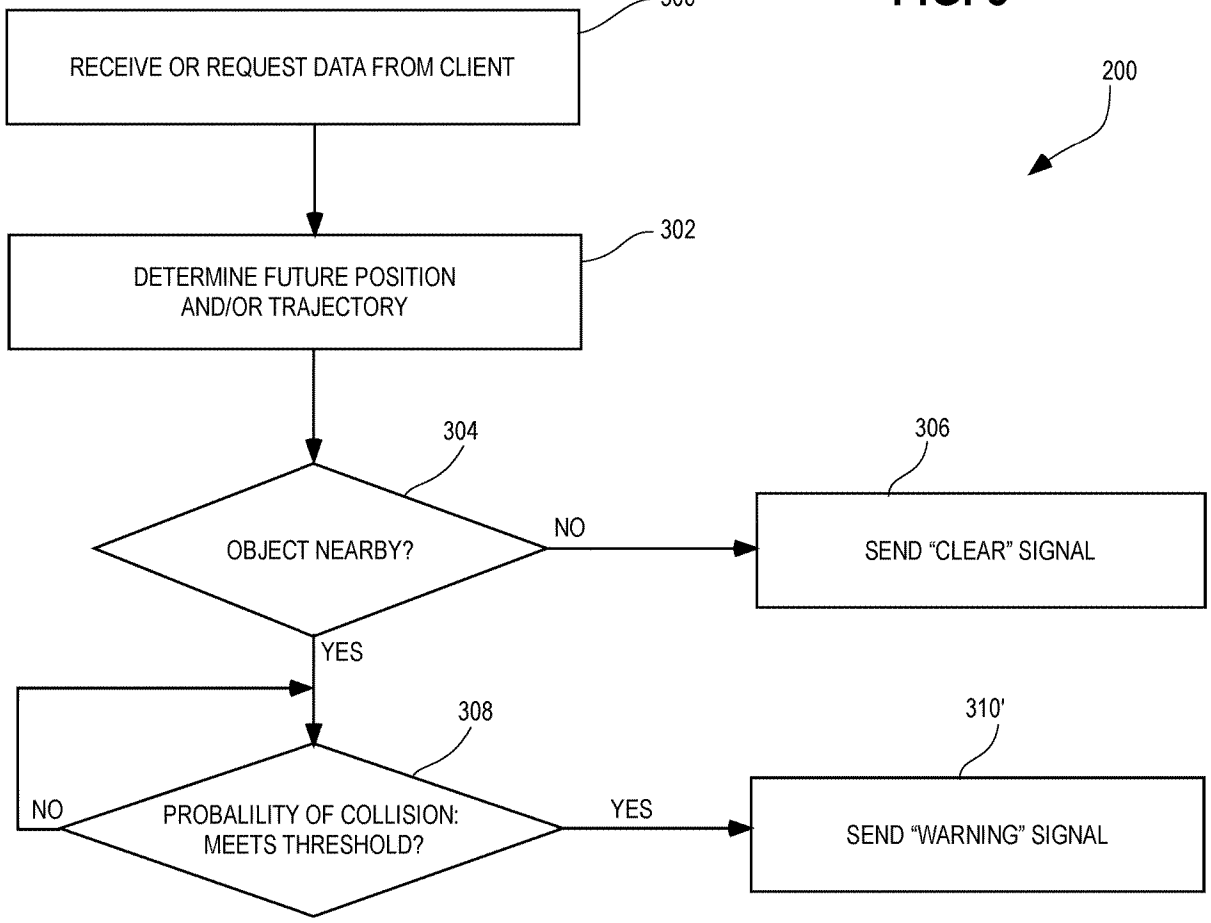
FIG. 3 is a flow diagram of logic to prevent a collision between a client and an object in accordance with one embodiment of the present disclosure.

FIG. 3 is a flow diagram of logic of the system 200. Each request by a client device (e.g., the client 102 of FIG. 2 or another client) and/or other receipt of information may trigger each logic step or process of the system 200, and each logic step or processes is performed continuously and in parallel. At process 300, the system 200 may receive, with at least one server (e.g., a local server), position and movement information of the client, which may remotely connect to the server through a wireless network. The position and/or movement information may be determined by the sensor of the client (see FIG. 2) as described above. At process 302, the system 200 may form a motion model of the client. As described in more detail below, the motion model of the client may include a predicted future position (and potentially a predicted future trajectory) of the client at a future time. The "future time" may be a substantially single point in time or a future time range (e.g., a range of 1 second to 10 seconds in the future, or another suitable range). At determination 304 (also called process 304, and it is noted that a "process" in this description may involve a determination), the system 200 may determine whether at least one object (e.g., a second vehicle, a pedestrian, a bike, etc.) will be within the proximity of the predicted position of the client at the future time. Herein, the "proximity" may be a relatively close distance at a certain point in time (e.g., 1 meter or less, 5 meters, 10 meters, 20 meters, or 50 meters or greater depending on the application). If process 304 determines that no object will be within the proximity of the predicted position of the client at the future time, the system 200, at process 306, may send a "clear" message to the client, which may indicate to the client that there is no apparent reason to alert an operator of danger, for example.

If process 304 determines that an object will be in the proximity of the client at the future time (or at least has a certain probability of being in the client's proximity), the system 200, at process 308, may determine a probability of a collision between the client and the object at the future time. This determination at process 308 may include analyzing and/or predicting behavior of object(s) in the proximity of the client, as described in more detail below. If the system 200 determines that the probability does not meet a threshold at process 308, the system 200 may repeat process 308 continuously until the system 200 determines that the detected object will no longer be in the proximity of the client and/or until the client shuts off, sends an "off" request to the server(s), etc. If process 308 determines that the probability meets the threshold, the system 200 may transmit a collision avoidance signal (e.g., a warning signal) to at least one of the client and the object at process 310. Each process noted in this paragraph and shown in FIG. 3 is described in more detail in the paragraphs below.

Figure 4:
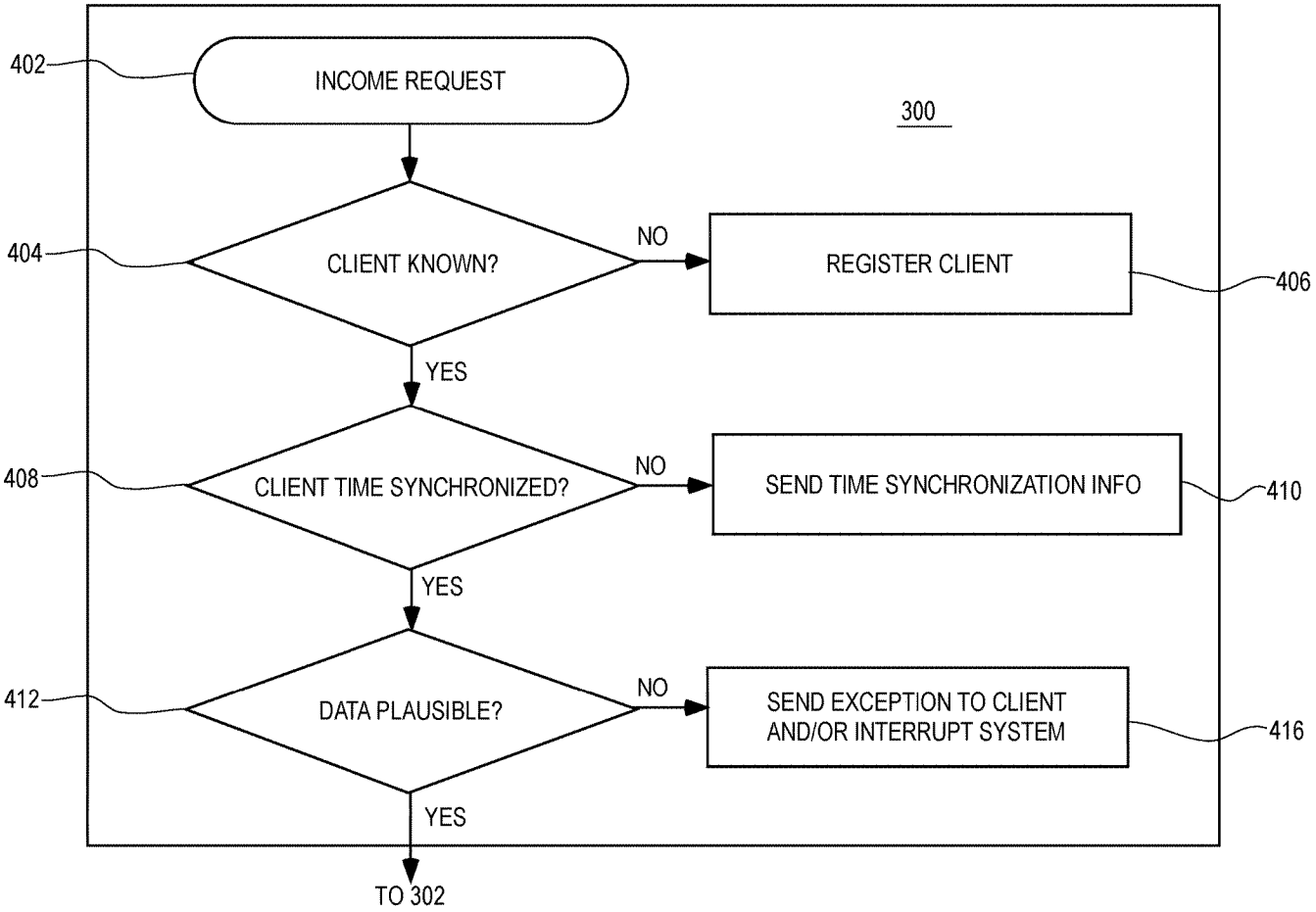
FIG. 4 is a diagram showing the embodiment of the process of FIG. 3 of receiving, with a server, position and movement information from the client in accordance with one embodiment of the present disclosure.

FIG. 4 is a diagram showing an embodiment of process 300 of receiving the position and movement information from a client, such as the client 102 (of FIG. 2). Process 300 may be performed within the server 202 (see FIG. 2). The process 300 may be initiated when the client sends a request message to the server, for example, along with certain data (e.g., sensor data collected from the sensor 120 of FIG. 2), at step 402. Alternatively or additionally, the server may send a request to the client, and the client may then return the requested information if available. When the client is an automobile or similar device, the client may send an initial notification to the server when its engine turns on or otherwise initiates its operation. The client may send and/or receive data through its communication with the server 202 at any suitable frequency, such as every 0.2 seconds, every 0.5 seconds, every second, every 5 seconds, etc. If communication between the server and the client is interrupted or not updated at a suitable frequency, the system 200 may be capable of extrapolating information to determine predicted location and movement data of the client (e.g., when the client enters a tunnel).

Once the incoming request is received at step 402, the system 200 may confirm that it recognizes the client at step 404 and then provide the client with an identity. For example, the system 200 may classify the client as "car," "truck," "train," "motorcycle," "pedestrian," "cyclist," "car," "not moving," "unknown," "unavailable," or any other suitable classification. The classification may be sent from the client, and/or it may be determined by the system 200 itself based on other information (particularly when such classification information is encrypted or does not exist, e.g., due to privacy regulations). For example, if "unavailable" or "unknown" is selected, the system 200 may register the client at step 406 such that the client will be recognized in the future (e.g., by tracking it's movement for a period of time to determine the type of client). As mentioned above, the data sent to and through the system 200 regarding client identification may be encrypted to comply with privacy regulations and other customs and laws in at least some countries.

At step 408 (which may be performed by a server as described above), the system 200 may confirm that the client time is synchronized with the system 200 (and any/all evaluated objects), thus ensuring that any delays or other variations in time are accounted for, which is of particular significance given the time sensitivity in suitable collision avoidance. For example, upon receiving the data, absolute and relative time data (e.g., date and time of the day) may confirm accuracy of sensor values (such as velocity information) by comparing such data to expected values. If the time data is not synchronized, the system 200 may adjust itself, and/or it may send synchronization information to the client at step 410. Step 410 may then instruct the client to adjust its sensors and/or adjust the way it is processing information such that data received by the system 200 is in proper form (e.g., synchronized).

Once synchronization is confirmed, plausibility of the data may be checked at step 412. The plausibility step may be performed by comparing the measured and processed data to predicted values, processing the data using two different methods and comparing the results, etc. If the system determines that the data is not plausible (e.g., due to errors in data transmission, or due to the wrong type of data collected and transmitted, for example), the system 200 may interrupt itself at step 416 and/or send an exception to the client at step 416. If the client receives the exception, it may relay an error message or error alarm to its operator/user, for example. If the system 200 interrupts itself, it may send a request to an administrator of the system 200 to check the system 200 for issues, and/or it may restart after a certain delay. If and when plausibility is confirmed at step 412, the system 200 may move to process 302.

Figure 5:
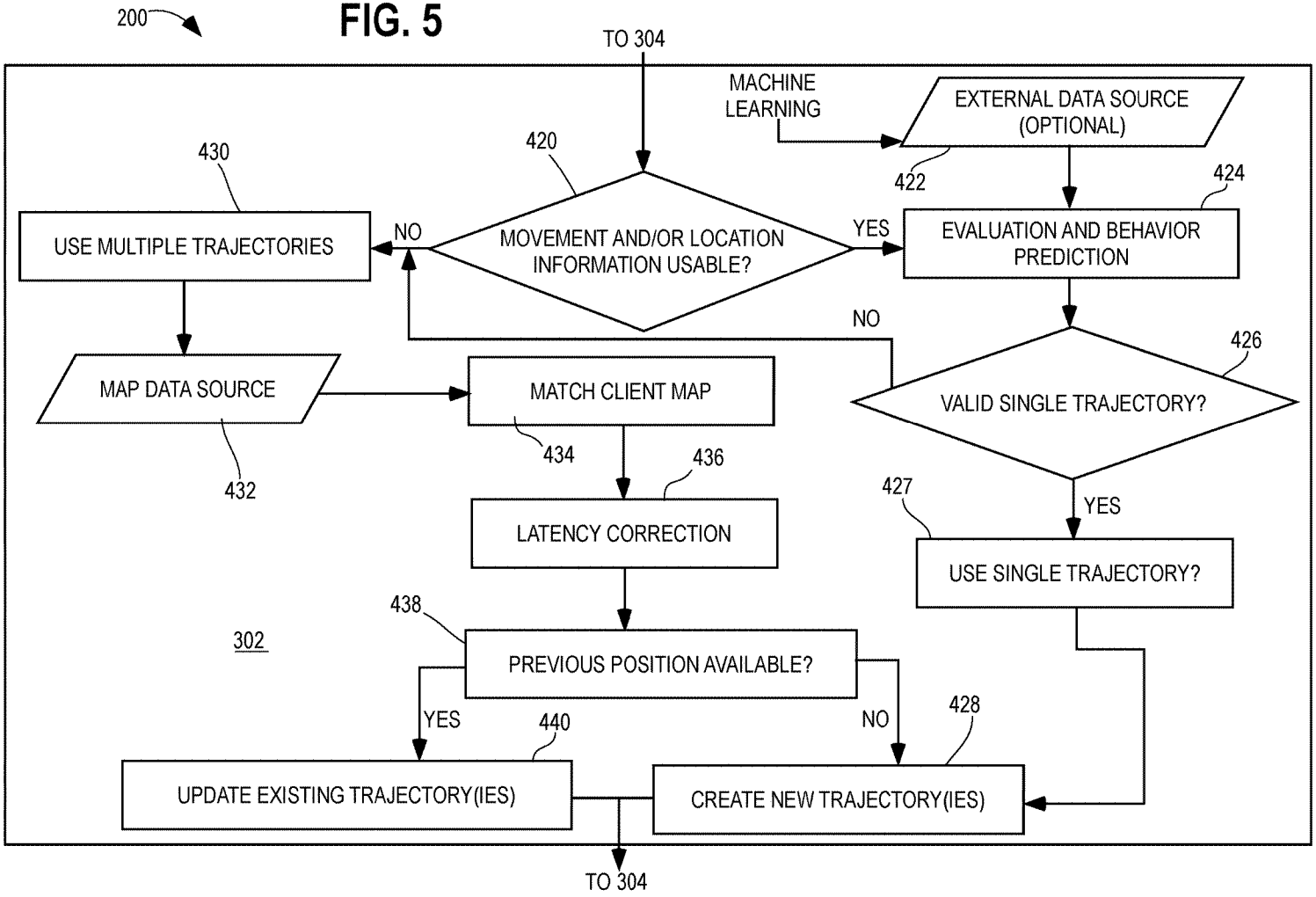
FIG. 5 is a diagram showing the process of FIG. 3 of forming a motion model of the vehicle to predict the position of the client in accordance with one embodiment of the present disclosure.

FIG. 5 is a diagram showing an embodiment of the process 302 (e.g., the process 302 of FIG. 3) of determining the future position and/or trajectory of the client. At step 420 (which continues from step 418 of FIG. 4), the system 200 may determine if the sensor data or other information related to the position and movement of the client is usable. In some instances, the system 200 may not have the ability to utilize the information received from process 300 if it is insufficient to determine certain characteristics about the trajectory of the client with a certain confidence level. When this is the case, the system 200 may use multiple trajectories at step 430 representing each possible trajectory, and it may weight each of the multiple trajectories equally. This is shown and described in more detail below with reference to FIG. 6.

However, referring still to FIG. 5, information related to the behavior of the client is available and usable, the system 200 may, at step 424, predict the behavior of the client based on that information and check the validity of the behavior prediction results. Behavior prediction is described in more detail below (with reference to FIG. 8, for example). A data source 422, which may include information relevant to the behavior prediction, may provide data for use in the evaluation and prediction step 424. The data source 422 may include information related to historically common routes, real time or predicted traffic information, data obtained from machine-learning methods regarding potential behavior of the vehicle, data collected by the system 200 related to the specific tendencies of the specific client or similar clients, etc.

In some instances, step 426 may determine that the client has a single trajectory, or has a very high probability of following a single trajectory (e.g., a probability of 95% or greater, 99% or greater, etc.). When this is the case, the system 200 may prepare the information regarding that single trajectory at step 427 for further analysis downstream at step 428. The single trajectory, which may include spatial information in at least two dimensions and a time dimension, is not necessarily limited to a single vector of information, but may include decisions by the driver the of the client.

If at step 420 there is no sensor data available, and/or if results at step 424 cannot determine that a specific single route will likely be used, multiple trajectories may be evaluated at step 430. The multiple trajectories used may be weighted by probability (which may incorporate data from the external data source 422), which is discussed in more detail below. A map data source (which may have multiple layers of data which may be continuously updated based on road conditions, traffic, etc.) may be utilized at step 432, and the multiple trajectories may be matched to the map data at step 434 (e.g., by pacing the vehicle/objects and their trajectories on a grid, thus creating a virtual model in the system 200). Optionally, step 434 may include the transmission of information to the client in a way such that the client can display the map data and trajectory information to its operator. In some instances, the client may be out of the range of a particular map handled by a regional server. When this situation occurs, the system 200 may redirect its functions to another server, if necessary.

After a latency correction step 436 (if necessary due to potential delays in processing, and/or due to difference in processing speeds between servers, for example), the system 200 may determine if it can leverage previous positions and trajectories of the client 102 at step 438 by updating existing trajectory data at step 440 (while incorporating any necessary map data), or it may alternatively create new trajectory data at step 428. Advantageously, leveraging existing trajectory data (when available) may save computing capacity of the server and take less time than creating a new trajectory data. The resulting information, which may represent a single trajectory of the client on a map or a probability map of multiple possible trajectories, may be sent downstream to process 304.

Figure 6:
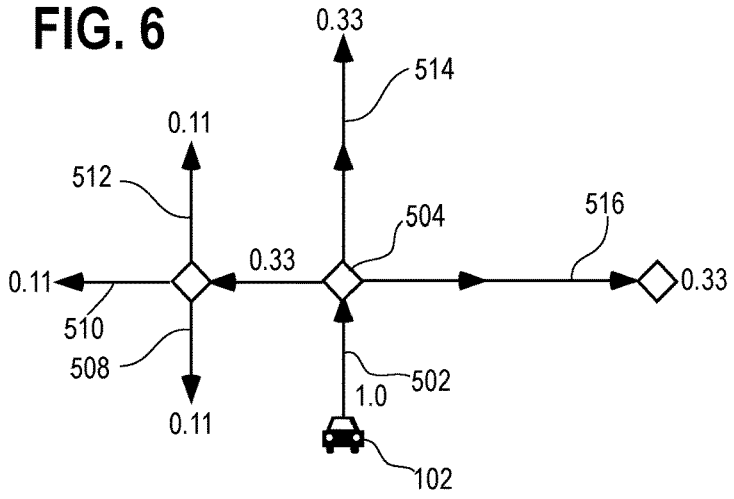
FIG. 6 is a diagram showing an example of a probability map used when predicting a position of a vehicle at a future time in accordance with one embodiment of the present disclosure.

FIG. 6 is a diagram showing an example of a probability map used when predicting the position of the client 102 at a time in the future. This diagram may represent a step of the process 302 (of FIG. 5), and in particular the step of evaluating the behavior prediction (step 424) and then using multiple trajectories (step 430) when a single trajectory cannot be determined with a threshold confidence. As shown, the probability map may incorporate turn prediction. For example, the client 102 may have a probability of 1.0 (i.e., 100%) or substantially 1.0 of driving through path 502, which may be determined based on real-time position and movement data received from a sensor of the client 102 by the system 200. Each vector along a path in FIG. 6 may not be to scale spatially, but may alternatively represent a period of time (e.g., 5 seconds). The map data source 432 (shown in FIG. 5) may determine that the client 102 will reach an intersection 504 at a certain future time or within a certain time range. The map data source 432 (FIG. 5) may also have information about the intersection 504, such as which direction has the right-of-way, if and when the intersection 504 will be associated with a green stoplight, a red stoplight, etc. If there is insufficient information based on where the client 102 is headed, the system 200 may determine that the car has an equal probability of turning left, going straight, and turning right, but other determinations are also contemplated. The system 200 may determine that, if the client 102 turns left at the intersection 504, it has a 1.0 probability of reaching a second intersection 506 thereafter. Then, if the system 200 determines that the client 102 has an equal probability of turning left, going straight, and turning right at the second intersection 504, the client 102 will have a determined probability of about 0.11 of ending up along each one of the paths 508, 510, and 512. The determined probability of ending up on each one of the paths 508, 510, and 510 may be a compound (or multiplied) probability of turning left at the first intersection 502 and then making the next respective decision at the second intersection 504. Since the client 102 will always (or substantially always) end up along the paths 514 and 516 if going straight or turning right at the first intersection 504, respectively, the total probability of the client 102 ending up along the paths 514 and 516 may be about 0.33 in this example.

Figure 7:
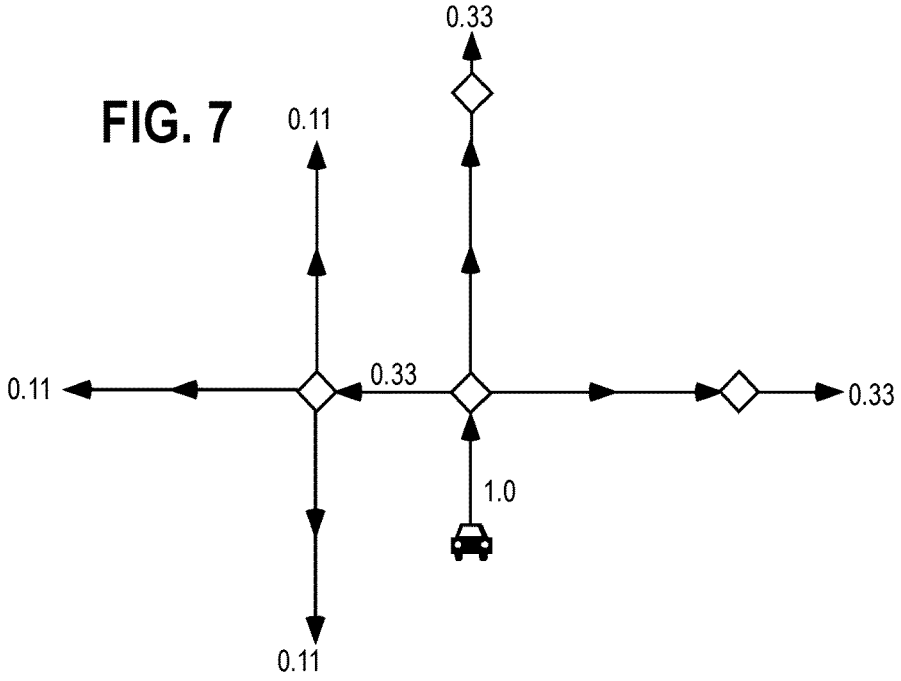
FIG. 7 is a diagram showing a second example of a probability map used when predicting a position of a vehicle at a future time in accordance with one embodiment of the present disclosure.

To limit the total number of computations required by the server, the estimated path probabilities may end once the paths are estimated a maximum prediction time a certain extend into the future (e.g., 20 seconds). For additional illustrative purposes, a diagram showing a similar second example of a probability map is depicted in FIG. 7. The probability map of FIG. 7 may be the similar or substantially the same as the probability map of FIG. 6, but with an increased maximum prediction time (e.g., 30 seconds). Higher or lower maximum prediction times are contemplated.

Figure 8:
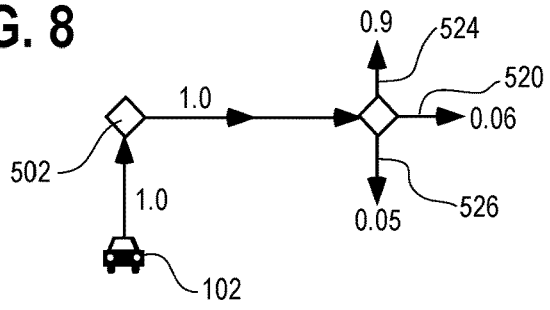
FIG. 8 is a diagram showing a third example of a probability map used when predicting a position of a vehicle at a future time in accordance with one embodiment of the present disclosure.

A diagram showing a third example of a probability map is depicted in FIG. 8. In this example, the system assigns different probabilities to the potential paths of the client 102. As shown, the system 200 may determine that there is a 1.0 probability of turning right at a first intersection 502, and then a 0.9 probability of turning left at a second intersection 520, thus providing a total probability of 0.9 of the client 102 ending up on the path 522. The vehicle may have a total probability of 0.05 of ending up on the path 524 and the path 526. Assigning weighted probabilities to different potential vehicle paths may be determined by historical driving data (e.g., data identifying typical driving habits of a particular driver at a particular time of the day, for example, and/or more popular routes vs. less popular routes), a known route (e.g., received from a GPS navigation system of the client 102, for example), or any other suitable information source. The map data of the system 200 and corresponding location data received by the system 200 from the objects may be updated in real time such that the system 200 can determine, at any given time, the location (or at least approximate location) and/or movement/trajectory of all objects utilizing the system.

Figure 9:
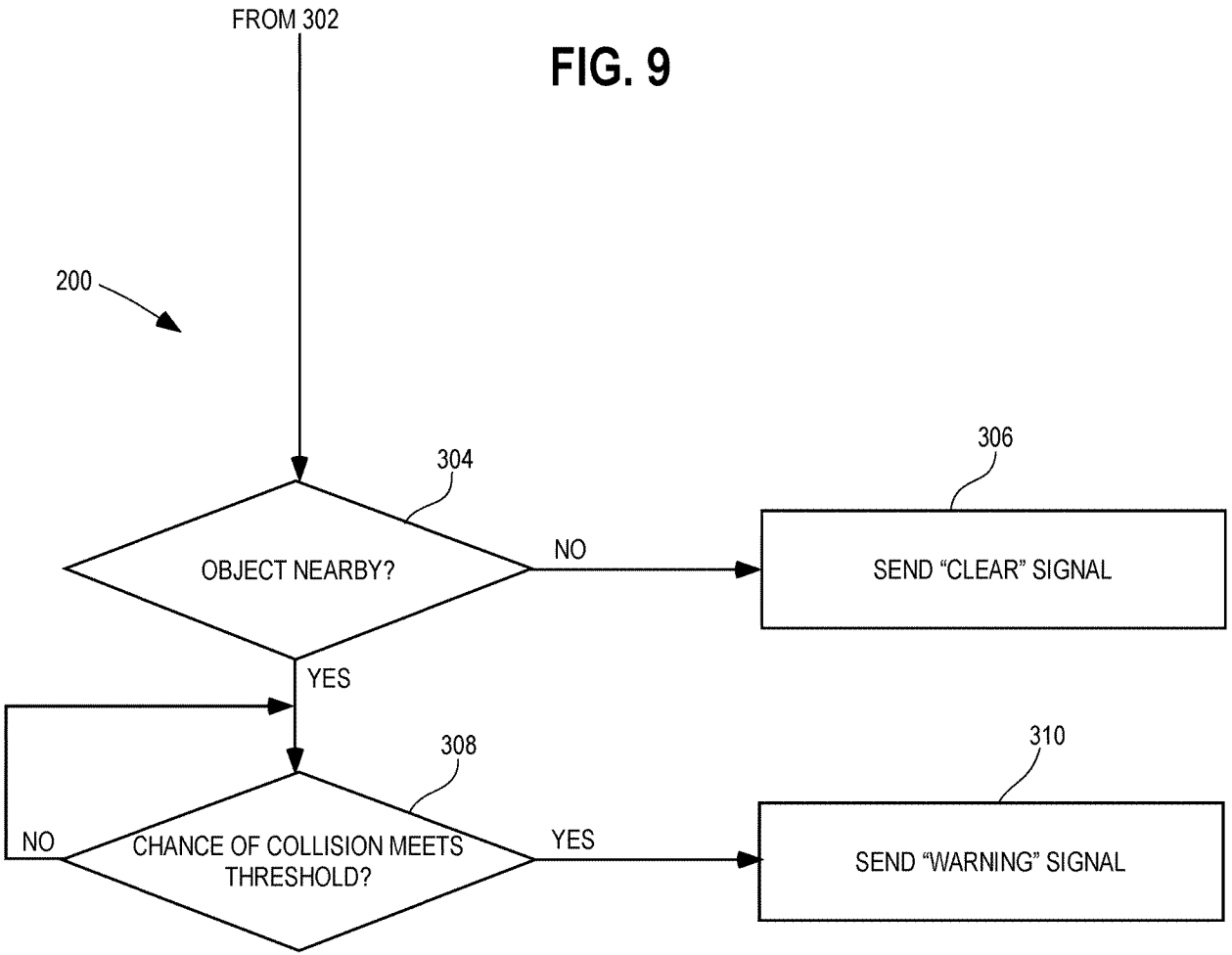
FIG. 9 is a diagram showing an embodiment of the process of FIG. 3 of determining whether an object will be in a proximity of the position of the vehicle of in accordance with one embodiment of the present disclosure.

FIG. 9 is a diagram showing an embodiment of the process 304 and 306 (as also shown in FIG. 3) of determining whether certain object(s) will be in a proximity of the position of the client. As noted above, the objects may be other vehicles, pedestrians, animals (e.g., a pet), small electric vehicles (e.g., mopeds, electric wheelchairs, etc.), and the like. In some embodiments, the system 200 may collect real time movement and position information from the objects to determine both a present location and a trajectory. For example, cell phones, wearables, and/or other devices with sensors may be used to collect real-time data. When it is desired and possible to collect real-time data for the purpose of predicting a trajectory, any and all of the portions of the system 200 described herein with respect to predicting the future position and trajectory of the client may also apply to predicting the future position and trajectory of the objects (in other words, the objects may also be clients). If the data from different object comes from different sources, the system 200 may include a pre-processing step such that the data from different objects can be used together. For example, certain filtering techniques may be used in data preparation (e.g. Kalmanfilter averaging, moving-window, bandpass, highpass, or lowpass). It is further contemplated that the pre-processing may occur at the object (prior to being sent to a server) to limit the amount of data transmitted through the wireless network, which may conserve bandwidth.

Figure 10C:
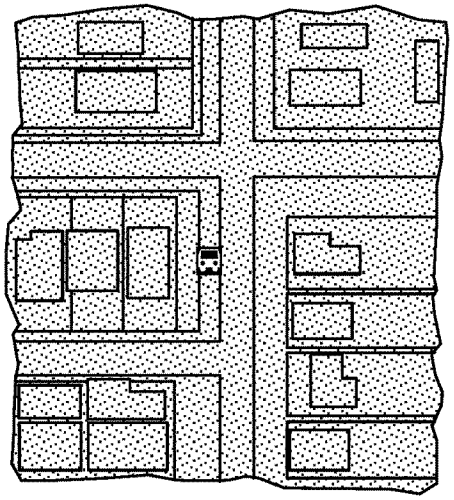
FIGS. 10A-10C show an illustration of matching different client types to a virtual map in accordance with one embodiment of the present disclosure.
Figure 10B:
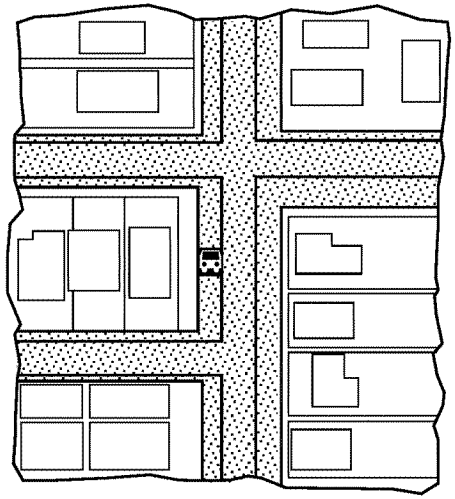
Figure 10A:
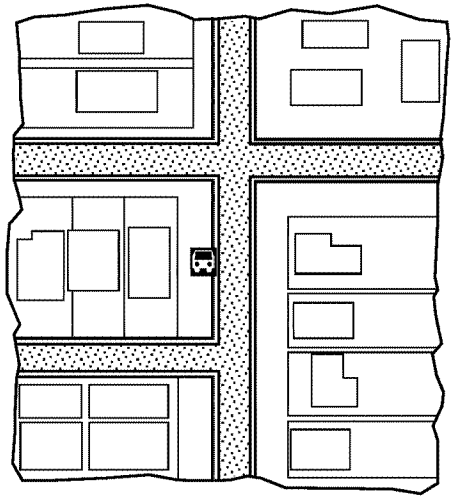

As described above, the system 200 may also match the objects to a map. FIGS. 10A-10C show an illustration of matching different client types to a map. In FIG. 10A, the system may determine that a "valid" area (e.g., the shaded area) is limited to a road only when the client is an automobile. Bicycles may be given a broader valid area that includes sidewalks, as shown in FIG. 10B. FIG. 10C shows a potential valid area for a pedestrian, which may be the entire area. This process may be performed during the step 434 (FIG. 5) when the objects are utilizing the system, and/or at process 304 (FIG. 9).

Figure 11:
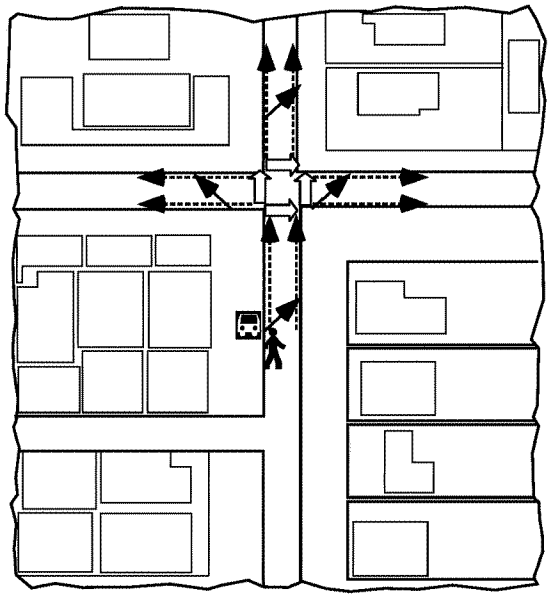
FIG. 11 is a diagram showing an example of a probability map used when predicting the future position of a pedestrian in accordance with one embodiment of the present disclosure.
Figure 12:
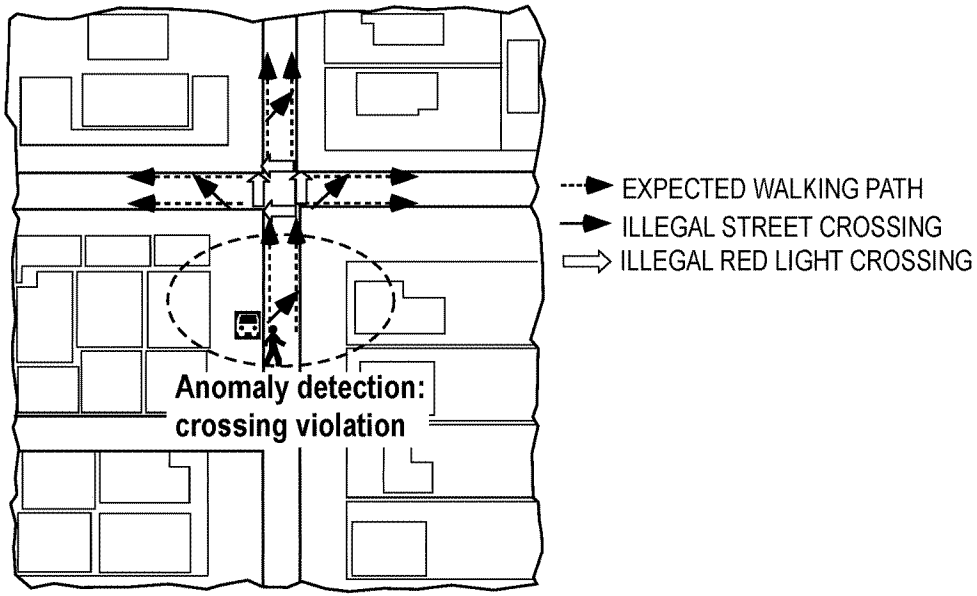
FIG. 12 is the diagram showing the example of a probability map of FIG. 11 after being updated to account for a detected anomaly.

Probability mapping may be used for predicting the future position of a pedestrian as depicted in FIG. 11. In this example, the pedestrian 116 may be given a certain probability of using an intersection 528, which may be an intersection which a vehicle utilizing the system 200 is approaching (or, has a probability of approaching). In the depicted probability map, the pedestrian is given a probability of 0.25 of not approaching the intersection, and a probability of 0.75 of approaching the intersection 528. The specific probabilities given may be based on data accessible to the system (e.g., through the cell phone of the pedestrian, through stored data from a database, etc.), and it is contemplated that it may incorporate historical data of the particular object, statistical data of other objects of the same type, logical condition trees, selected assumptions (e.g., selected by the user of the system 200), machine learning, etc. The pedestrian may be given a certain probability of performing misbehavior with respect to customary or legal behavior (such as performing an illegal street crossing) of 0.05 as shown in FIG. 11. As shown in FIG. 12, if an anomaly is detected (e.g., by sensing a movement of the pedestrian 116), the probabilities may be updated. This information may be used in steps 304 and/or 308 of FIG. 9 as described herein.

In some potential instances, no (or limited) real-time data for certain objects will be available. Referring to FIG. 9, it is contemplated that the process 304 of determining the present and/or future position of the object may be based on information other than from a sensor. For example, the system 200 may incorporate traffic-flow information to predict the location of certain objects (e.g., vehicles) at certain times of the day on certain days of the week. In another example, the system 200 may incorporate information based on when and where children typically walk to or from school, and thus may predict that such children will be in certain locations at certain times. Many other examples are contemplated.

If the system 200 determines that no object will be in the proximity of the client, the system 200 may send an optional signal to the client at process 306 indicating to the client that the route is clear of known objects and the chance of a collision is low. The relevant proximity to the client may be determined by the system 200 based on the classification of the client, the velocity of the client, the unpredictability of the client and/or potential collision objects, etc. The client may indicate this determination to the user. In other embodiments, the default state of the client may be a state where no notification or alarm warns of potential collisions so such a "clear" signal may not be necessary.

If, however, the system 200 determines that at least one object will be in the proximity of the client at a certain time, the system 200 may determine a probability of a collision between the client and the object based on variety of considerations. For example, when specific, single-trajectory data is known for both the client and the object, the system 200 may simply compare the trajectory vectors of the vehicle and the object to determine whether or not the client and the object will be in the same location at any point in time. However, often specific trajectories will not be known with certainty. Thus, the system may instead determine a probability (i.e., a probability) based on known information, such as determined trajectory probabilities, known or determined misbehavior probabilities, etc. For example, and for non-limiting illustration purposes only, if the client has a 0.5 probability of being in a future time (or within a future time period) as determined in accordance with the description above, and an object has a 0.2 probability of being within the trajectory at that future time or time period (e.g., due to a determined trajectory and/or misbehavior), the system 200 may determine that the probability of a collision is 0.1 (i.e., 0.5×0.2=0.1).

Once a probability of a collision is determined by the system 200, the probability is compared to a threshold value at process 308. For example, the threshold value may be set at any suitable value, and may vary depending on the application (e.g., a low-speed collision with a relatively low-risk of injury may have a lower threshold than a high-speed collision). While any suitable threshold may be used, it is contemplated that the threshold may be set at 0.1% (or lower), 0.5%, 1%, 5%, 10%, etc. If the determined probability is below the threshold, process 308 may be repeated for as long as the system 200 determines that an object will be in the proximity of the client. If the probability ever breaches the threshold, the system 200 may send a collision avoidance signal to the client and/or the object at process 310. The collision avoidance signal may initiate an alarm or other warning to the user of the vehicle. In certain circumstances (e.g., when the probability of a collision is extremely high), the system 200 may alter the operation of the client automatically. It is contemplated, for example, that the system 200 may govern the speed of the client if the client is an automobile, and the system 200 may even shut down the engine or other power-providing device of the client while (optionally) activating the brakes of the client. When another object such as a pedestrian or cyclist receives the collision avoidance signal, the collision avoidance signal may transmitted to the object in the form of haptic, visual, or audio feedback, for example through a smartphone or wearable device.

In some embodiments, the system 200 may incorporate automatic machine learning for various functions or processes. For example, machine learning may be utilized for classifying the client type at step 424 (FIG. 4), predicting the movement of a client of the system to thus anticipate when and where potential collision objects will be in the proximity of the client, to anticipate the movements of those potential collision objects, to determine probability of misbehavior of certain objects, etc. The machine learning may be implemented in any suitable self-learning device or method, such as an artificial neural network, a random decision forest ensemble, a support vector machine, a convolutional network, or any other suitable device or method available at the time of the filing of this application or that may be developed in the future.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method comprising the steps of:

receiving, with at least one server, position and movement information from a remote first client;

determining a first valid area for the first client and then forming a motion model of the first client within the first valid area, the motion model including a predicted position of the first client at a future time;

receiving, with the at least one server, position and movement information from a remote second client;

determining a second valid area for the first client and then forming a second motion model of the second client within the second valid area, the second valid area extending beyond a roadway, and the second motion model including a predicted position of the second client at the time; and determining whether the second client will be in a proximity of the position of the first client at the time.

2. The method of claim 1, further comprising:

determining a probability of a collision between the first client and the second client at the time if it is determined that the object will be in the proximity of the position of the first client at the time; and if the probability meets a threshold, transmitting a collision avoidance signal to at least one of the first client and the second client.

3. The method of claim 1, further comprising synchronizing the received information from the first client with the received information of the second client.

4. The method of claim 1, further comprising detecting, with a sensor, the position and movement information of the first client, wherein the sensor is coupled to the first client.

5. The method of claim 4, further comprising detecting, with a second sensor, the position and movement information of the second client, wherein the second sensor is coupled to the second client, and wherein the second sensor is included in at least one of a smart phone and a wearable device.

6. The method of claim 1, wherein forming the motion model of the first client includes forming a probability map including multiple trajectories, wherein each trajectory of the multiple trajectories is weighted by probability.

7. The method of claim 1, wherein the at least one server includes a first server that communicates with a second server via a cloud-computing network.

8. The method of claim 7, wherein the position and movement information of the first client is received by the first server and wherein the position and movement information of the second client is received by the second server.

* * * * *